US005337681A

United States Patent [19]

Schrage

[11] Patent Number: 5,337,681

[45] Date of Patent: Aug. 16, 1994

[54] RECYCLABLE PLASTIC PALLET

[76] Inventor: David A. Schrage, 62452 Schoenherr, Washington Township, Macomb County, Mich. 48094

[21] Appl. No.: 941,511

[22] Filed: Sep. 8, 1992

Related U.S. Application Data

[63] Continuation-in-part of Ser. No. 919,595, Jul. 24, 1992.

[51] Int. Cl.[5] ..... B65D 19/12

[52] U.S. Cl. ..... 108/56.1; 108/51.1; 411/508

[58] Field of Search ..... 108/56.1, 55.5, 55.1, 108/51.1, 53.3, 901, 902; 411/508, 509

[56] References Cited

U.S. PATENT DOCUMENTS

| | | | |
|---|---|---|---|
| 2,503,022 | 4/1950 | Benoist et al. | 108/56.1 |
| 3,316,861 | 5/1967 | Dailey | 108/901 |
| 3,719,342 | 3/1973 | Kupersmit | 108/901 |
| 3,759,194 | 9/1973 | Fuji et al. . | |
| 4,051,787 | 10/1977 | Nishitani et al. . | |
| 4,062,300 | 12/1977 | Real | 108/56.1 |
| 4,062,301 | 12/1977 | Pitchford | 108/56.1 |
| 4,316,419 | 2/1982 | Cupido . | |
| 4,359,948 | 11/1982 | Judy et al. . | |
| 4,509,432 | 4/1985 | Win . | |
| 4,765,252 | 8/1988 | Shuert . | |
| 4,838,176 | 6/1989 | Bowser, Sr. et al. . | |
| 4,843,976 | 7/1989 | Pigott et al. . | |
| 4,952,106 | 8/1990 | Kubogochi et al. | 411/508 |
| 4,987,639 | 1/1991 | Baiuley et al. | 411/508 |
| 5,007,352 | 4/1991 | Calkoen | 108/56.1 |
| 5,180,134 | 1/1993 | Mallak | 108/55.1 |
| 5,191,513 | 3/1993 | Sugiura et al. | 411/508 |
| 5,197,396 | 3/1993 | Breezer et al. | 108/901 |

FOREIGN PATENT DOCUMENTS

| | | | |
|---|---|---|---|
| 400640 | 12/1990 | European Pat. Off. | 108/901 |
| 2241289 | 3/1973 | Fed. Rep. of Germany | 108/901 |
| 588387 | 5/1977 | Switzerland | 108/901 |

*Primary Examiner*—Michael Milano

*Attorney, Agent, or Firm*—Brooks & Kushman

[57] ABSTRACT

A recyclable plastic pallet (220) upon which objects may be stacked is described. The pallet (220) comprises longitudinally spaced and laterally extending elongate front and back plastic rails (230, 232, 233, 234) having openings 258. The pallet also has laterally spaced and longitudinally extending elongate plastic slats (236) with apertures (254) therein. Retainers (238) are cooperatively received in the openings (258) of the rails (230, 232, 233, 234) and into the apertures (254) of the slats (236) to join the slats (236) and rails (230, 232, 233, 234) together to form pallet (220).

17 Claims, 6 Drawing Sheets

RECYCLABLE PLASTIC PALLET

CROSS REFERENCE TO RELATED APPLICATIONS

This application is a continuation-in-part to U.S. Ser. No.07/919,595, entitled Recyclable Plastic Pallet and filed on Jul. 24, 1992.

TECHNICAL FIELD

This invention relates to pallets upon which objects or boxes may be stacked, and more particularly, concerns pallets having attachment means for securing straps or wrapping sheets of stretch film.

BACKGROUND ART

Conventionally, pallets are made from wooden boards or planks. The pallets are constructed by spacing apart a plurality of wooden rails and then nailing, perpendicular to the rails, spaced wooden slats to the top and bottom surfaces of the rails. Objects or boxes may then be stacked atop the top surface of the pallet. The pallet, with its load, may then be easily lifted and moved by a fork lift.

A plastic wrapping sheet of stretch film is often used to secure the stacked objects relative to the pallet. A first end of the wrapping sheet is typically tied about the end of a slat adjacent a rail and wrapped in a spiral manner about the pallet and stacked objects, thereby maintaining the stacked objects in relation to the pallet. The wrapping sheet is often 1½ to 3 feet in height and is stretched tightly to cling against the pallet and stacked objects. The free end of the wrapping sheet is simply pressed into clinging frictional engagement against a previous spiral turn of the wrapping sheet to secure the untied end.

Alternatively, the stacked objects or boxes may be banded or strapped to the wooden pallet. A band is run around the rails or slats and over the load. The band is then pulled tight and the free ends of the band are clipped to another portion of the band by metal or plastic clips to maintain tension in the band.

These conventional wooden pallets and fastening techniques have numerous shortcomings. First, the pallets are generally not recyclable. Once the useful life of the pallets has been exhausted, the pallets are generally thrown away. If the pallets are not disassembled with their nails being removed and recycled, the nail may rust and become a hazard. The wooden rails and slats are often placed in landfills, thereby adding to the size of already overburdened landfills.

Second, the wooden pallets are unsanitary. The wooden pallets may rot and also serve to host insects and rodents. If the wooden pallets become dirty or contaminated, the wooden pallets are difficult to clean.

Third, the wooden pallets may splinter and cause harm to workers using the wooden pallets. Fourth, the wooden pallets are relative heavy which may result in difficulty in handling, back problems for users, and associated loss of the user's time from work.

Fifth, the wooden pallets are not adapted for compatible use with wrapping sheets of stretch film or with bands. The smooth edges of the wooden pallets do not allow the ends of the wrapping sheets to be quickly and easily attached to the wooden pallets. Rather, the ends of the wrapping sheets must be tied about the wooden pallets. This is time consuming both in terms of attachment and detachment. Also, the spirally wrapped wrapping sheets have a tendency to creep up the sides of the wooden pallets and loosen about a load secured upon the wooden pallet. Further, metal or plastic clips used to fasten the bands, often require separate tools to effect the fastening of the clips to the bands. Finally, the scrapping of the clips also presents disposal problems.

Pallets have previously been made from plastic. However, these pallets are generally unitarily molded or else, are not readily assembled at a work site. Therefore, when the pallets are unloaded and are being transported, these pallets take up a significant amount of space. Further, if a small portion of one of these pallets is damaged, generally, the entire pallet must be discarded as the repair of unitary or assembled plastic pallets is difficult.

The present invention has been developed to remedy many of the aforementioned shortcomings.

SUMMARY OF THE INVENTION

The present invention includes a pallet upon which objects or boxes may be stacked and to which a wrapping sheet, or a strap, may be secured to retain the objects in relation to the pallet. The pallet preferably comprises longitudinally spaced and laterally extending elongate front and back rails. Preferably, an intermediate rail is longitudinally spaced therebetween. The rails each have vertically spaced top and bottom surfaces. The pallet preferably also has laterally spaced and longitudinally extending elongate slats. The slats are secured to the top and bottom surfaces of the rails.

Preferably, the pallet includes an anchoring means about which the wrapping sheet can be wrapped to quickly retain the wrapping sheet in relation to the pallet. The anchoring means may include channels into which the wrapping sheet is wedgingly or frictionally retained. A laterally extending tongue may be formed between the channels. The tongue may include laterally spaced slots inclined in relation to the laterally extending tongue and may also include a plurality of projections extending therefrom. The channels, the slots and the projections cooperate to wedgingly and frictionally engage and retain the wrapping sheet to the pallet.

The rails may have exterior surfaces including a plurality of projections extending therefrom. The projections should be dimensioned such that the wrapping sheet may be stretchably engaged and retained by the projections.

At least one of the rails has an end with at least one groove formed therein so that the wrapping sheet may be stretchably secured within the groove. The wrapping sheet is thereby impeded from moving upwardly when wrapped about the groove.

The front and back rails may have ends with corner supports including laterally and longitudinally extending flanges extending vertically above the respective top surfaces of the rails. The corner supports cooperate with one another to prevent objects stacked atop the pallet from moving laterally or longitudinally. Further, the corner supports should be dimensioned to cooperate with one another to receive another pallet therebetween, whereby similar pallets may be stackably retained one atop another.

The bottom surfaces of the rails have laterally spaced recesses formed therein which are adapted to receive the forks of a fork lift.

The slats may have top surfaces which have vertically extending anti-skid ribs formed thereon to inhibit the sliding of objects upon the top surfaces of the slats. The ribs preferably are orthogonally orientated with respect to one another so as to prevent sliding in the lateral and longitudinal directions.

At least one of the rails may have a plurality of vertically spaced slots extending therethrough for cooperatively and releasably retaining a strap in a self-locking manner. Similarly, at least one of the slats may have a plurality of laterally spaced slots formed therethrough for cooperatively and releasably retaining the strap in a self-locking manner.

The pallets have indicia formed therein which are representative of the material from which the pallet is made or else indicative of the size of pallet. For example, the pallets may be different colors to represent different sizes of pallets.

The slats may have apertures formed therein. Also the top and bottom surfaces of the rails may have vertically extending stakes. The stakes are dimensioned to be cooperatively received within the apertures of the slats to retain the slats to the rails. The stakes and apertures preferably are joined in a press-fit manner. The stakes preferably have enlarged heads over which the apertures are pressed to retain the slats to the rails. In a first embodiment, the stakes and the apertures are heat-staked together as well.

The rails may have spaced notches which receive associated slats so that the top surfaces of the rails and the top surfaces of the slats cooperate to form a flush, planar top surface on the pallet. The lateral edges of the slats may have laterally outwardly extending flanges and the notches may have undercuts, the flanges and undercuts being press-fit together to form an interlocking joint.

In a second embodiment of a pallet made in accordance with the present invention, at least one of the rails has a retainer receiving opening formed therein. At least one of the slats has an aperture. Further, the pallet includes a retainer cooperatively held in the opening of the rail and in the aperture of the slat to join the slat and rail together.

The retainer preferably has an enlarged head and a body and the aperture has a countersink. The body of the nail extends into the aperture of the slat and into the opening of the rail with the enlarged head residing within the countersink to prevent the head from passing completely through the aperture. Also, the body may have at least one rib extending transverse to the opening in the rail. The opening may have at least one shoulder which cooperatively receives the rib to prevent the retainer from being withdrawn from the opening. The rail may have a slot extending perpendicular to and intersecting with the opening, the shoulder being formed by the slot.

The slat of the second embodiment may also have a U-shaped recess with a pair of vertically extending and longitudinally spaced flanges, the spaced flanges capturing the top or bottom surface of the rail between the flanges.

Alternatively, the retainer may be formed integrally with the slat during molding. The nail is still cooperatively received within the opening in the rail to retain the slat to the rail.

Further, the second embodiment includes a method of joining a slat to a rail in a recyclable plastic pallet. The method comprises the steps of molding a slat having an aperture, molding a rail having an opening, and inserting a retainer into the aperture of the slat and into the opening of the rail to cooperatively interlock the slat to the rail.

Finally, the second embodiment includes a method for removing and replacing a slat from a rail of a recyclable plastic pallet. The slat has an aperture and the rail has an opening with a shoulder formed therein. A retainer, having a rib thereon which cooperates with the shoulder of the opening in the rail, is positioned within the aperture and the opening to cooperatively interlock the slat to the rail.

The method includes cutting the slat between the retainer and the rail and removing the slat from the rail. The rib is then accessed and removed from the retainer. The retainer is then withdrawn from the opening of the rail.

A replacement rail, also having an aperture, is placed upon the rail and another retainer is inserted into the aperture of the replacement slat and into the opening of the rail to retain the replacement slat to the rail.

Pallets, made in accordance with the present invention, may include any one or a combination of the above described features.

It is an object of the present invention to provide the pallet having an anchoring means about which a wrapping sheet of stretch film may be quickly attached and detached.

An additional object is to provide a pallet having rails with ends possessing at least one groove formed therein so that the wrapping sheet may be stretchably secured within the groove, thereby keeping the wrapping sheet from moving upwardly when wrapped about the pallet.

Still yet another object is to provide pallets having corner supports which cooperate with one another to prevent objects stacked on top of the pallets from moving laterally or longitudinally, and further, to allow pallets to be stackably retained one atop another.

Another object is to provide a pallet having a plurality of projections extending from exterior surfaces on the pallet such that a wrapping sheet wrapped about the pallet may stretchably engage the projections thereby preventing the wrapping sheet from moving relative to the pallet.

A further object is to provide a pallet with rails having vertically extending stakes and slats having apertures, wherein the stakes are cooperatively received within the apertures to retain the slats to the rails thereby forming the pallet. Preferably, the slats and rails are press-fit together to form interlocking or interfitting joints.

Still yet another object is to provide a pallet wherein at least one of the rails or one of the slats has a plurality of spaced slots formed therethrough for cooperatively and releasably retaining a strap in a self-locking manner.

Another object of the invention is to provide a pallet having a plurality of rails and slats which are held together by retainers and a method of making the pallet.

Also, it is an object to provide a pallet which is easily assembled and which occupies only a small amount of packaging space prior to its assembly, thereby allowing a large number of unassembled pallets to be shipped on a single truck or train car.

An additional object is to provide a method for replacing a slat secured to a rail of a recyclable plastic pallet.

Other objects, features and advantages will become more readily apparent from the following description and accompanying sheet of drawings.

BEST MODES FOR CARRYING OUT THE INVENTION

Figure 1:
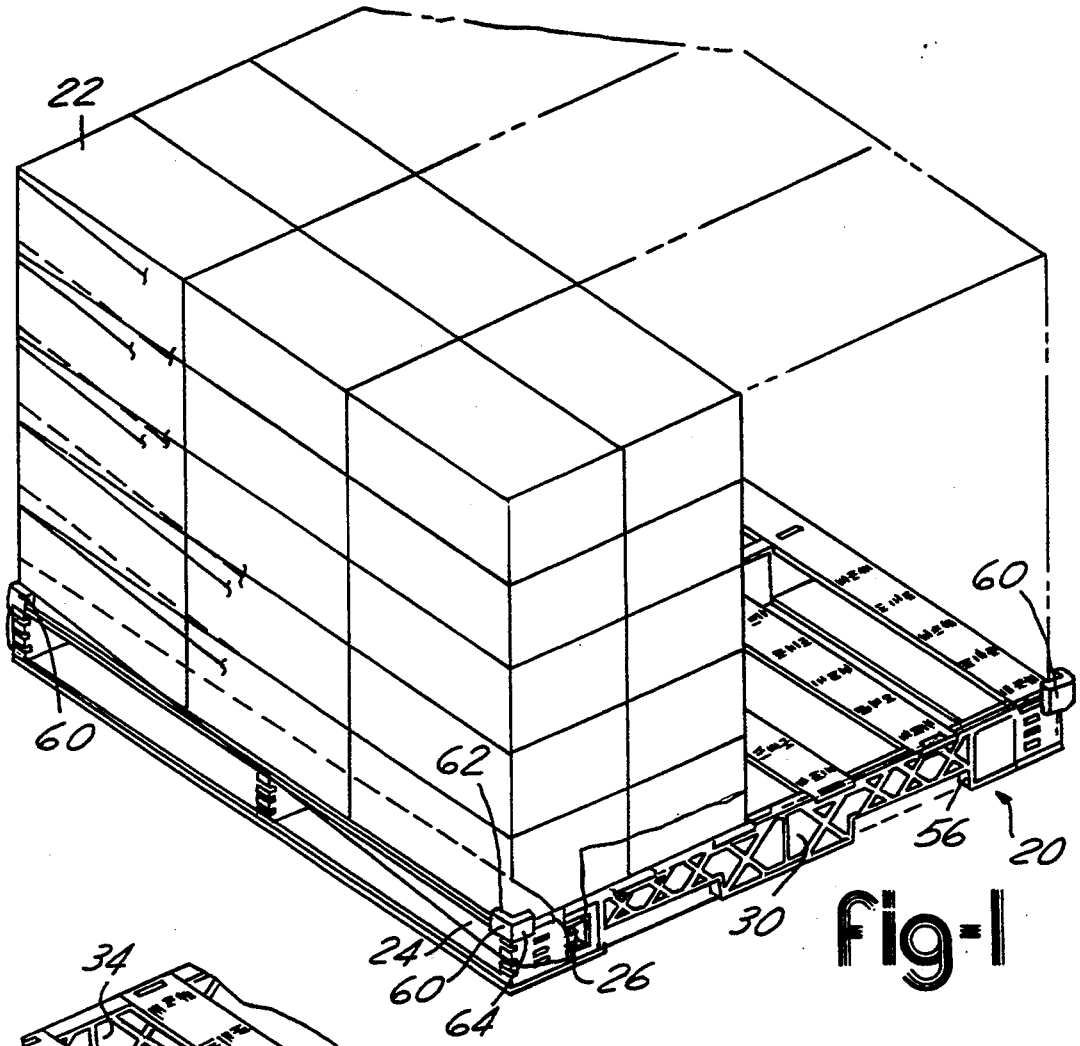
FIG. 1 is a perspective view, partially cutaway, of a pallet made in accordance with the present invention, having objects or boxes stacked on top thereof, with a wrapping sheet of stretch film being spirally wrapped about the pallet and boxes.

In a first preferred embodiment of the present invention, a pallet 20 is shown in FIG. 1 with a large number of boxes or objects 22 secured to the pallet 20 by a plastic wrapping sheet of stretch film 24. An end 26 of wrapping sheet 24 is attached to the pallet 20 and is then wrapped in a spiral manner about the perimeter of the pallet 20 and the perimeter of the boxes or objects 22 stacked on top of pallet 20.

Figure 2:
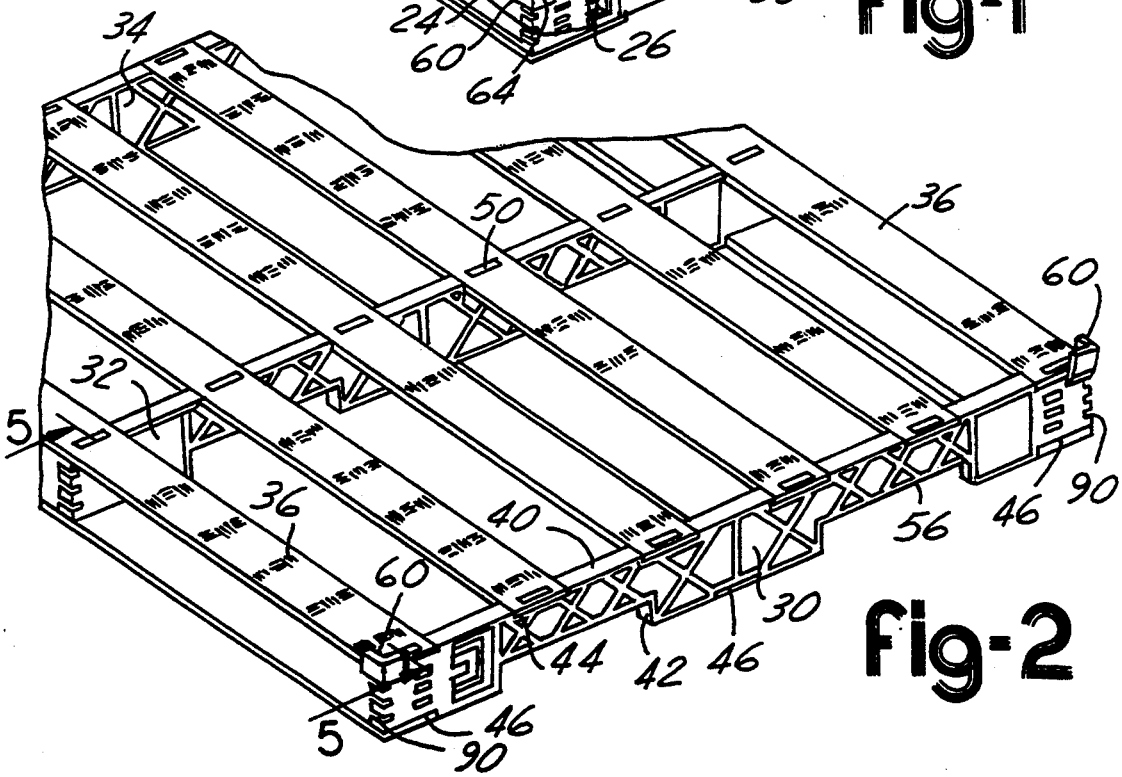
FIG. 2 is a fragmentary perspective view of the pallet.

FIG. 2 shows a fragmentary view of the pallet 20 without boxes 22. Pallet 20 comprises a plurality of longitudinally spaced and laterally extending elongate rails including front rail 30, an intermediate rail 32 and a back rail 34. Pallet 20 also has a plurality of laterally spaced and longitudinally extending elongate slats 36 which are secured to rails 30, 32 and 34. Rails 30, 32, and 34 are generally identically formed, except for differences which will be described below. Preferably, slats 36 are also identically formed with respect to one another.

Figure 15:
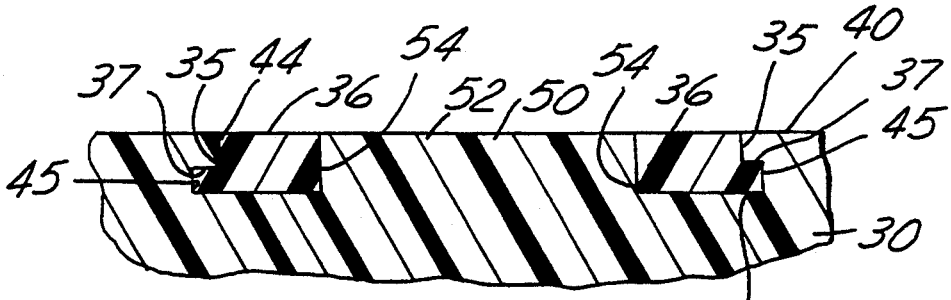
FIG. 15 is a sectional view taken along line 15—15 of FIG. 3.
Figure 16:
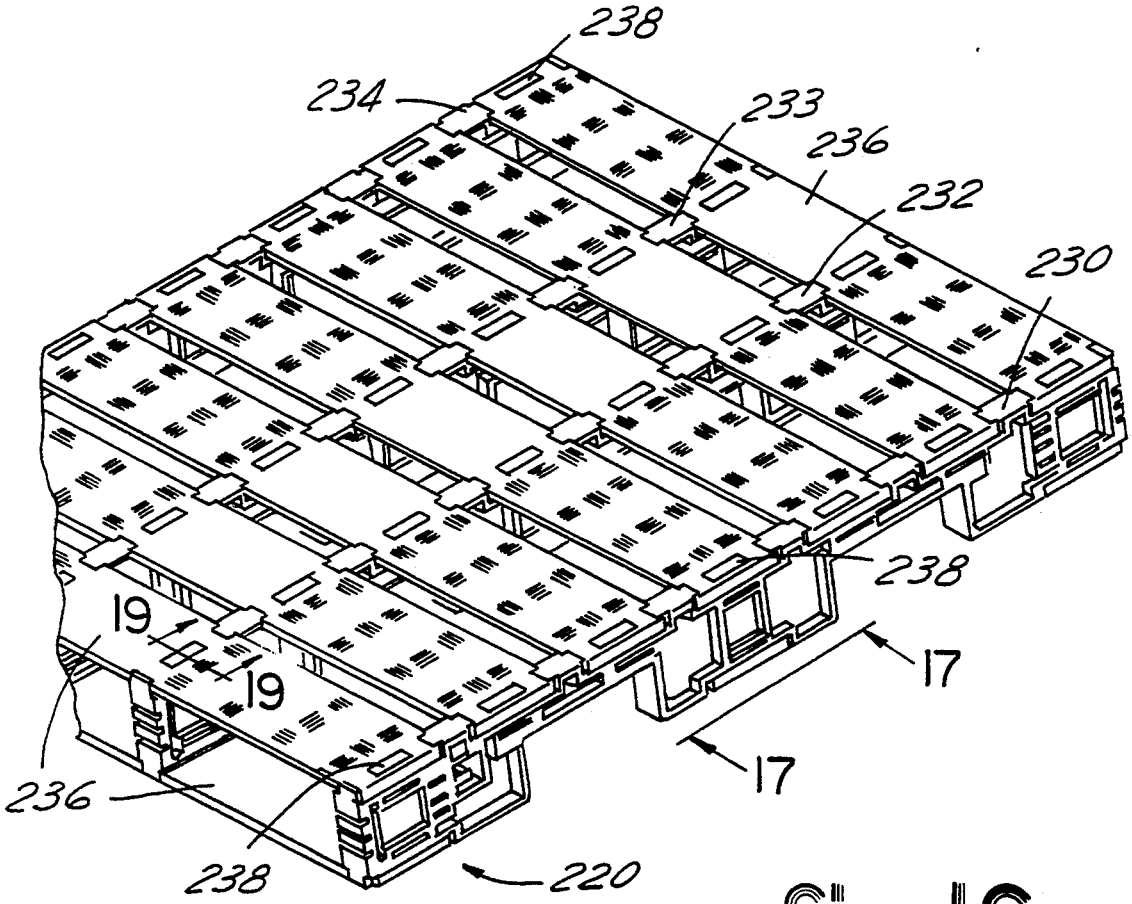
FIG. 16 is a perspective view of a recyclable plastic pallet made in accordance with a second preferred embodiment of the present invention.

Referring to FIGS. 2–4 and 15, rail 30 has a top surface 40 and a bottom surface 42. Formed in top surface 40 are a plurality of laterally spaced notches 44 which are sized and configured to snugly receive cross-sectional perimeter portions of slats 36 therein. As best seen in FIG. 15, slats 36 have steps 35 formed therein at locations corresponding to notches 46. Steps 35 define laterally outwardly extending flanges 37. Notches 44 have undercuts 45 adjacent their bottom surfaces. Flanges 37 of slats 36 are press-fit into undercuts 45 of notches 44 thereby forming interlocking joints.

Likewise, bottom surface 42 has notches 46 for receiving slats 36. Rails 32 and 34 similarly retain slats 36 in notches 44 and 46. Slats 36 have top and bottom surfaces 38 and 39. Top and bottom notches 44 and 46 are designed to receive slats 36 therein such that top surfaces 38 of slats 36 and top surfaces 40 of rails 30, 32 and 34, as well as bottom surfaces 39 of slats 36 and bottom surfaces 42 of rails 30, 32, and 34 cooperate to form flush, planar top and bottom surfaces to pallet 20.

Figure 5:
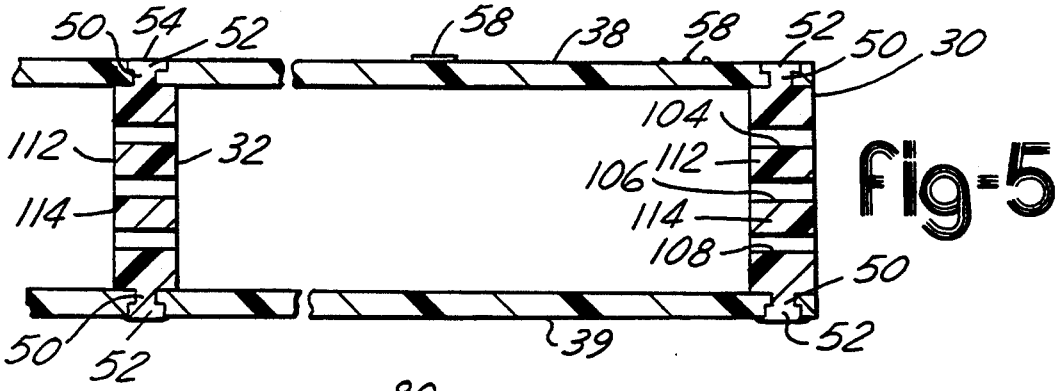
FIG. 5 is a fragmentary sectional view taken along line 5—5 of FIG. 2.
Figure 13:
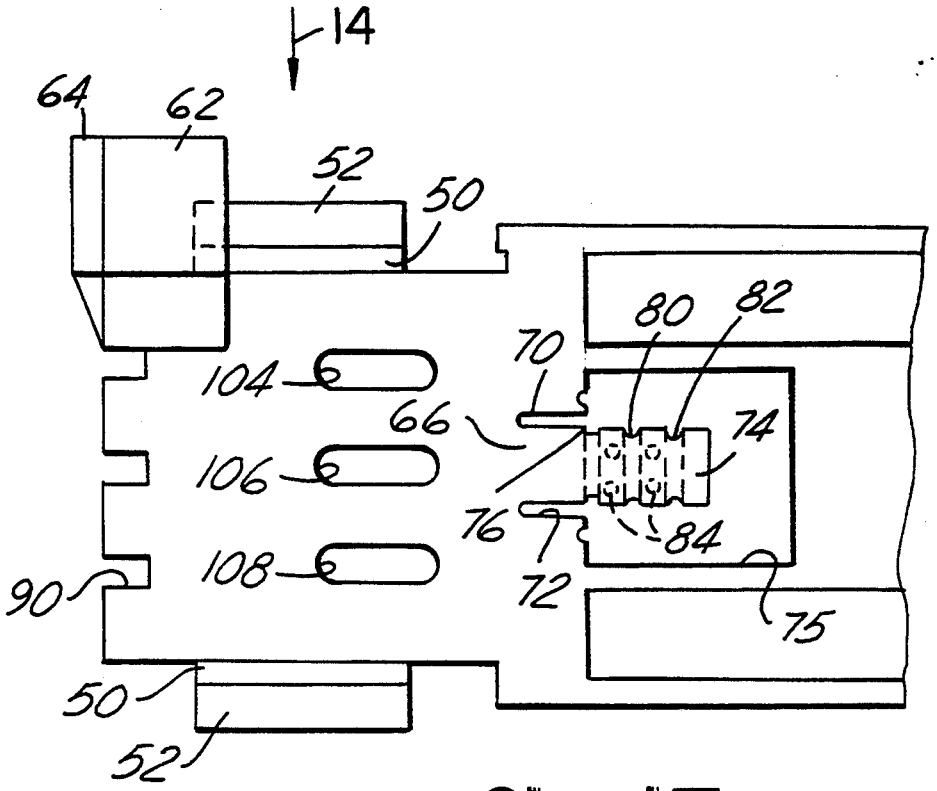
FIG. 13 is an enlarged fragmentary front view of a rail.
Figure 14:
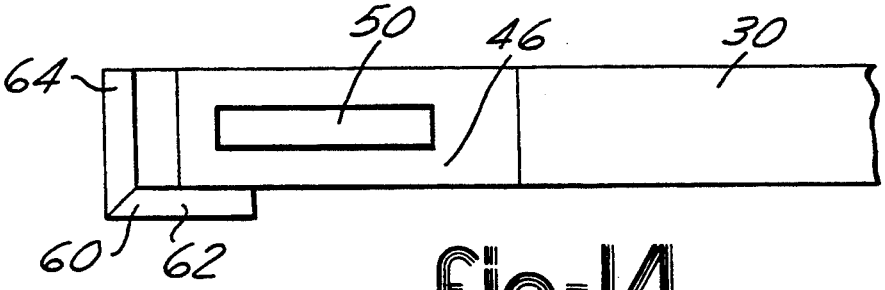
FIG. 14 a top view taken along arrow 14 of FIG. 13.

Top and bottom surfaces 40 and 42 of rails 30, 32 and 34 further include stakes 50 which have enlarged heads 52, as best seen in FIGS. 5 and 13. Slats 36 have longitudinally spaced apertures 54 which are sized and configured to receive enlarged heads 52 in a press-fit manner. Once slats 36 are pressed over enlarged heads 52 of stakes 50, enlarged heads 52 and apertures 54 are then heat staked together. Note, that prior to heat-staking, stakes 50 extend vertically beyond top and bottom surfaces 38 and 39 of rail 30. After heat-staking, stakes 50 are flush with slats 36, as seen in FIG. 15. The combination of slats 36 being interlocked into respective top and bottom notches 44 and 46, apertures 54 being press-fit over stakes 50 and then being heat-staked together, results in pallet 20 being structurally stable and rigid.

Returning to FIG. 2, pallet 20 is adapted to receive forks of a fork lift in either a lateral or a longitudinal direction. Bottom surfaces 42 of rails 30, 32 and 34 have pairs of inverted U-shaped spaced openings 56 formed therein to receive the forks. In the lateral direction, the forks can be inserted into the regions between the upper and lower slats 36 on either longitudinal side of intermediate rail 32. Therefore, pallet 20 may be easily lifted and moved by a fork lift. Shown in phantom are a pair of reinforcing bars 57 which may be molded into openings 56 to create an enhanced strength box section to openings 56.

Figure 3:
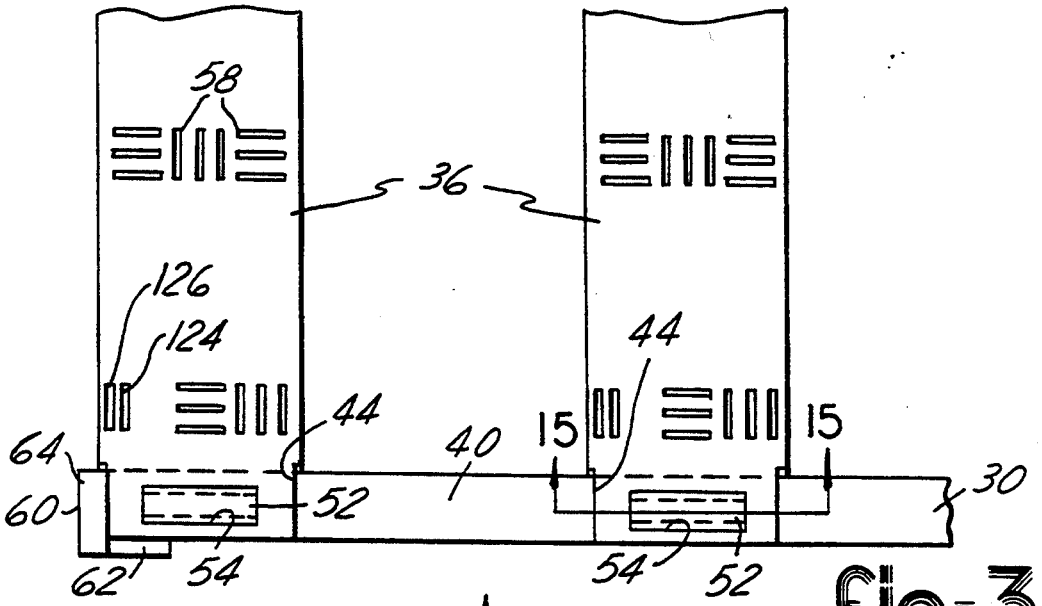
FIG. 3 is a fragmentary top view of a corner of the pallet.
Figure 4:
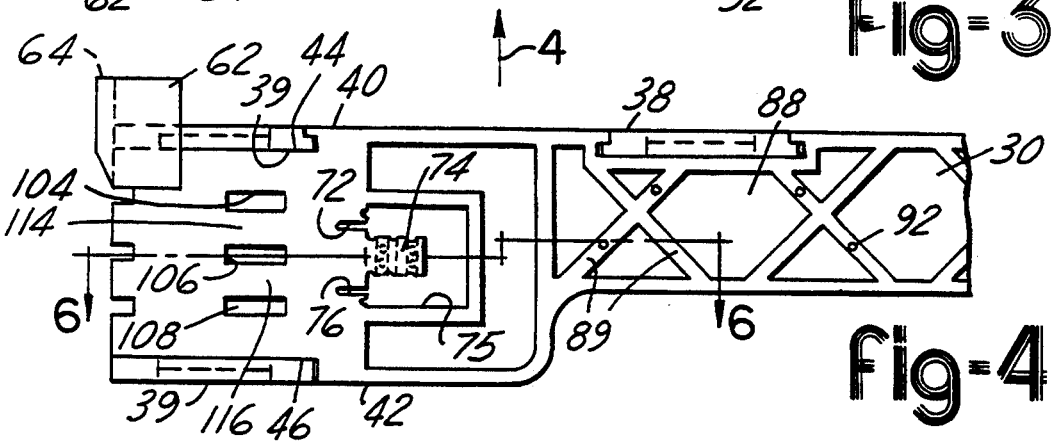
FIG. 4 is a fragmentary front view taken along arrow 4 of FIG. 3.

Slats 36 have vertically extending anti-skid ribs 58 located on their exterior surfaces, as seen in FIGS. 2 and 3. Ribs 58 are spaced along slats 36 and extend orthogonally with respect to one another in longitudinal and lateral directions thereby inhibiting movement of boxes or objects stacked atop pallet 20.

Corner supports 60 are provided at each of the ends of rails 30 and 34. Note that intermediate rail 32 does not have a corner support formed at its ends. Corner supports 60 have laterally and longitudinally extending flanges 62 and 64 extending vertically above the top surface 40 of rails 30 and 34. Flanges 62 and 64 are located outside top surfaces 40 and cooperate with another such that similar pallets 20 may be stacked one atop another. Further, corner supports 60 serve to retain boxes 22 from moving laterally or longitudinally upon pallet 20 when boxes 22 are wrapped together by wrapping sheet 24.

Figure 6:
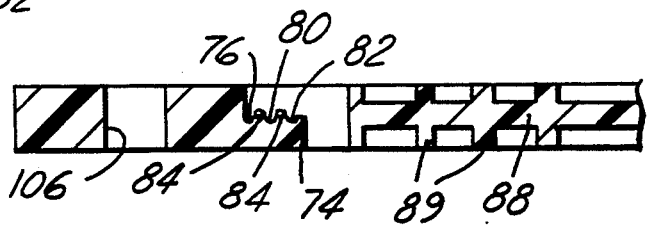
FIG. 6 is a fragmentary sectional view taken along line 6—6 of FIG. 4.

FIGS. 4, 7–8 and 13 illustrate an anchoring means 66 to which end 26 of wrapping sheet 24 may be quickly attached and detached. Anchoring means 66 includes a pair of vertically spaced and laterally extending channels 70 and 72 and a laterally extending tongue 74. An opening 75 is formed about tongue 74 to provide easy access to tongue 74 and channels 70 and 72. Tongue 74, as seen in FIGS. 6 and 13, has three laterally spaced channels 76, 80 and 82 formed therein which extend around all but the front face of tongue 74. The back side of tongue 74 also has four spaced projections 84 extending rearwardly. Projections 84 are vertically and laterally spaced in pairs, with respect to one another, as shown in hidden lines in FIG. 13.

Figure 7:
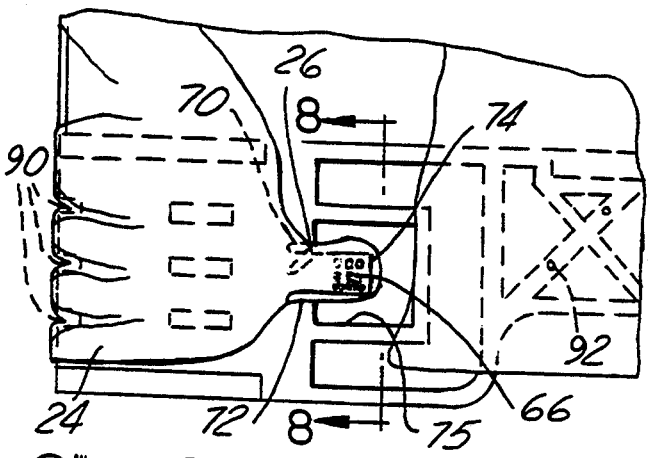
FIG. 7 is a fragmentary front view showing a wrapping sheet wrapping about an anchoring means and being stretchably retained in grooves in the end of a rail of the pallet.
Figure 8:
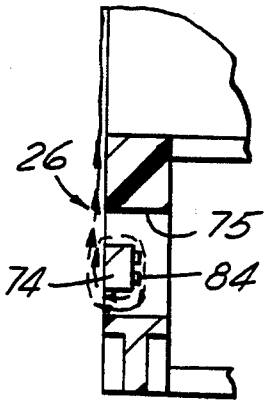
FIG. 8 is a sectional view taken along line 8—8 of FIG. 7.
Figure 9:
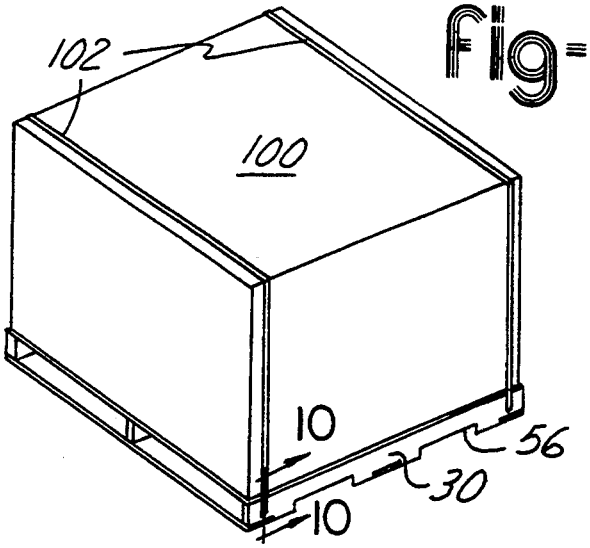
FIG. 9 shows a large box on top of the pallet which is secured by a pair of longitudinally extending straps.
Figure 10:
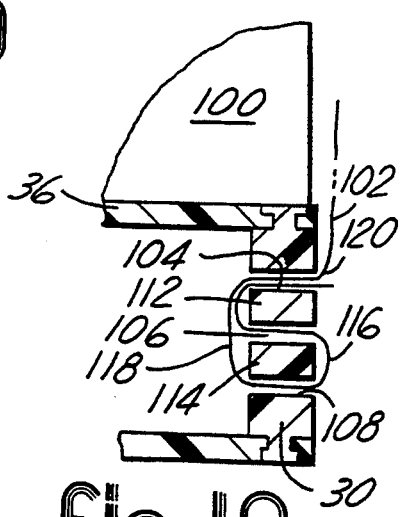
FIG. 10 is an enlarged fragmentary view taken along line 10—10 of FIG. 9 showing one of the straps self-locking about slots in a rail of the pallet.

In operation, as seen in FIGS. 7 and 8, end 26 of wrapping sheet 24 is twisted until it becomes rope-like and is then wrapped about anchoring means 66. First, a portion of end 26 is wedgingly or frictionally received within upper channel 70. Wrapping sheet 24 may then extend about channels 76, 80 and 82 and projections 84. Next, wrapping sheet 24 is pulled into wedging reception within lower channel 72. Wrapping sheet 24 is then vertically spread as it is spirally wrapped about pallet 20 and boxes 22, as shown in FIG. 1.

FIG. 6 illustrates that rail 30 has a thinned web 88 and diagonal extending and criss-crossing braces 89. Thinned web 88 reduces the overall weight of pallet 20 while braces 89 maintain structural strength.

Pallet 20 has a couple of features to impede wrapping sheet 24 from climbing up boxes 22 and away from pallet 20. First, at each of the ends of rails 30, 32 and 34, are a plurality of vertically spaced corner grooves 90 which stretchably retain wrapping sheet 24 therein. See FIG. 7. Again, this prevents wrapping sheet 24 from moving upwardly away from grooves 90 of pallet 20.

Second, along the exterior or outwardly facing surfaces of rails 30 and 34, are located projections 92 extending outwardly from braces 89. As wrapping sheet 24 is stretchably wrapped about pallet 20, wrapping sheet 24 is stretchably retained about projections 92. Again, these projections 92 serve to anchor wrapping sheet 24 in place.

Alternative means for securing a large box or object 100 to pallet 20 is shown in FIGS. 9–12. In this case, a strap 102 is tightly wrapped about box 100 with strap 102 being retained in a self-locking manner to pallet 20. Strap 102 preferably has a surface with a fairly high coefficient of friction.

Looking to FIGS. 4–5 and 9–10, front rail 30 has three vertically spaced slots, namely, upper slot 104, middle slot 106 and lower slot 108 which form bars 112 and 114 therebetween. The end of strap 102 may be defined into three separate portions, an S-shaped leading portion 116 which extends through slots 104, 106 and 108 and wraps about bars 112 and 114, an intermediate portion 118 which extends rearwardly of bars 112 and 114, and a trailing portion 120 which extends through slot 104 and connects to the remainder of strap 102, which is wrapped about box 100.

When its desired to tighten strap 102, leading portion 116 of strap 102 is pulled causing strap 102 to tension about box 100 with trailing portion 120 moving rearwardly through slot 104, intermediate portion 118 moving downwardly toward slot 108, and leading portion 116 sliding about bars 112 and 114 with the free end of strap 102 moving away from pallet 20.

Conversely, when a pulling force is applied to trailing portion 120 in a direction away from leading portion 116, strap 102 will self-lock about pallet 20. As tension is applied to trailing portion 120, intermediate portion 118 tightens and compresses leading portion 116 against the back surface and back corners of bar 112. This frictional engagement of leading portion 116 between bar 112 and intermediate portion 118 is sufficient to prevent strap 102 from unlocking if sufficient tension is placed across strap 102. This self-locking of strap 102 eliminates the need for additional clips to fasten strap 102 to itself to maintain strap 102 wrapped about box 100.

Figure 11:
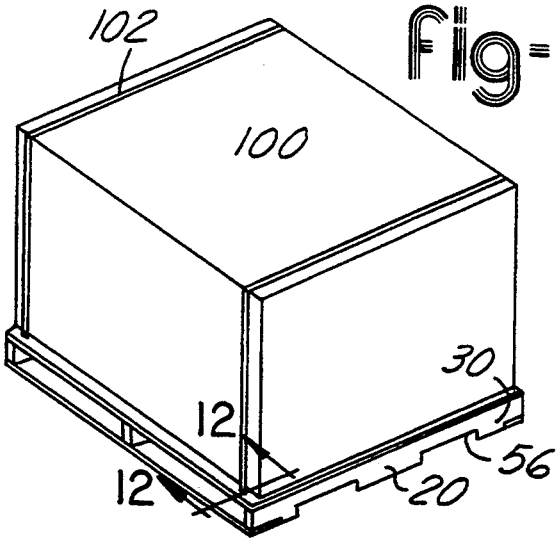
FIG. 11 is a perspective view of the box atop the pallet being retained by a pair of laterally extending straps.
Figure 12:
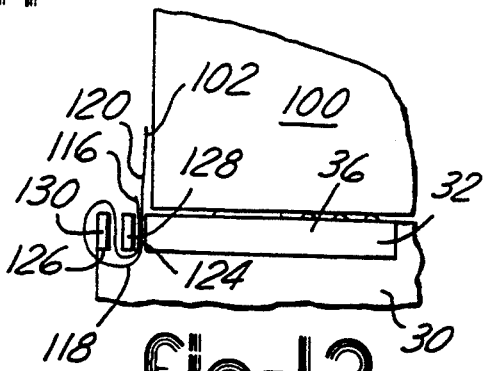
FIG. 12 is a sectional view taken along line 12—12 of FIG. 11 showing one of the straps self-locking about slots in a slat of the pallet.

Looking now to FIGS. 3 and 11–12, slats 36 have slots 124 and 126 formed therein which cooperate with strap 102 to self-lock strap 102 when box 100 is laterally secured by straps 102. Bars 128 and 130 are formed between slots 124, 126 and the lateral outboard edge of slat 36. In the manner just described above, leading portion 116 is frictionally retained against the lower surface and corners of bar 128 by intermediate portion 118 when sufficient tension is applied across strap 102 thereby self-locking strap 102 to slat 36.

This invention also includes a method of making a pallet 20 for retaining objects atop thereof. The method comprises first providing thermoplastic material. Preferably, pallet 20 is made from recycled thermoplastic materials such as polyethylene or polypropylene. This material may be obtained from recycling centers which grind up post-consumer waste products such as plastic beverages bottles. Also, old pallets may be recycled to produce pallet 20 described above.

Next, elongate rails 30, 32 and 34 and elongate slats 36 are molded. Slats 36 and rails 30, 32 and 34 are then connected to form a generally rectangular pallet. The pallet is preferably rigidly formed by way of mechanical interlocking joints as have been described above with respect to slats 36 and rails 32, 34 and 36. Optionally, heat-staking may also be used. The rails or slats may have any of the structural features formed therein which have been described above with respect to pallet 20.

FIGS. 16–20 show a second preferred embodiment of a pallet 220 made in accordance with the present invention. Pallet 220 includes respective front, first and second intermediate and rear rails 230, 232, 233 and 234 which are longitudinally spaced and are laterally extending. Slats 236, which are laterally spaced and longitudinally extending, are joined to rails 230, 232, 233 and 234 by a combination of interlocking features.

Figure 17:
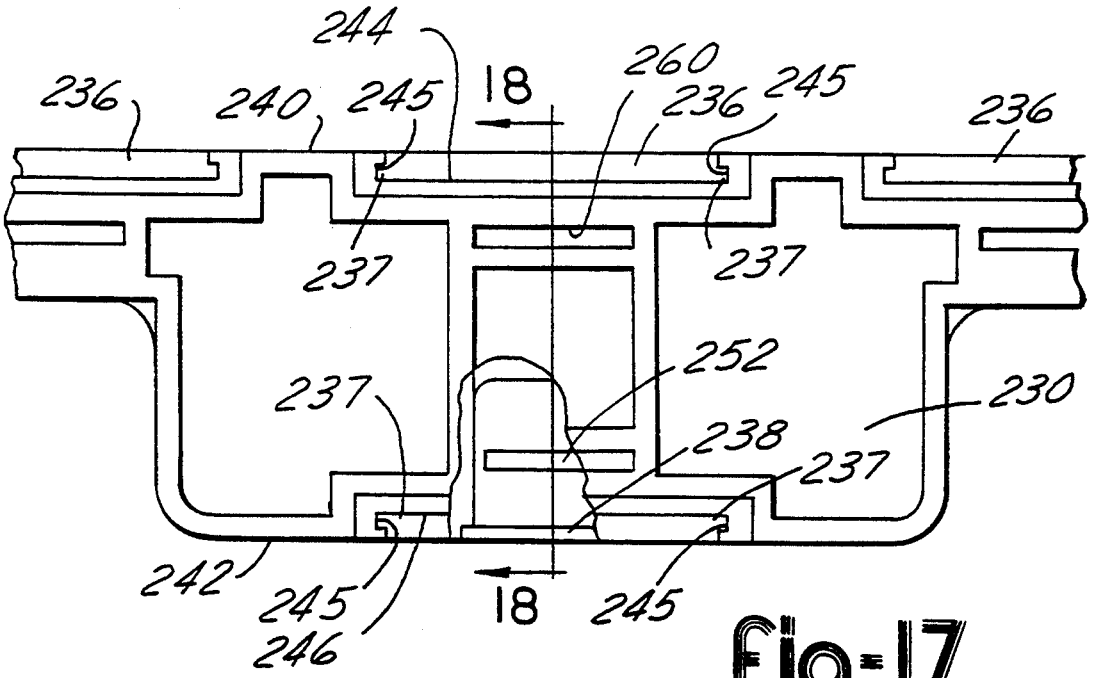
FIG. 17 is a fragmentary view looking along line 17—17 of FIG. 16.

Looking to FIG. 17, a first interlocking feature between a rail and a slat is shown. Front rail 230 has top and bottom surfaces 240 and 242 with respective top and bottom notches 244 and 246 formed therein. Each of rails 232, 233 and 234 have similar notches 244 and 246 for receiving slots 236. Undercuts 245 are formed in notches 244 and 246. Slats 236 have laterally outwardly extending flanges 237 which are configured to be press-fit into undercuts 245 to assist in retaining slats 236 to rails 230, 232, 233 and 234.

Figure 18:
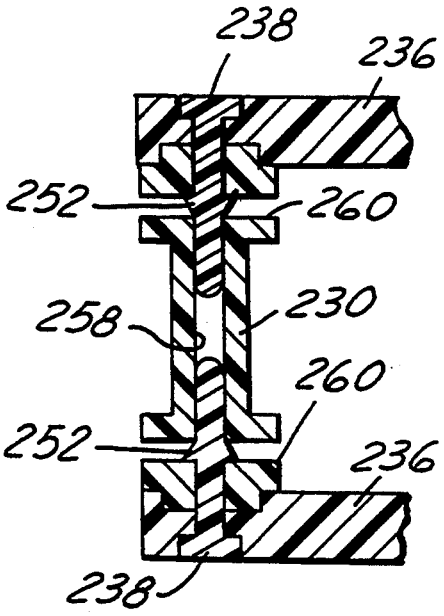
FIG. 18 is a fragmentary sectional view taken along line 18—18 of FIG. 17.

FIG. 18 shows a second interlocking feature. A pair of lower and upper retainers 238 are shown retaining a pair of vertically spaced slats 236 to front rail 230. Each of slats 236 is similarly joined to respective rails 232, 233 and 234 at their intersection.

Figure 20:
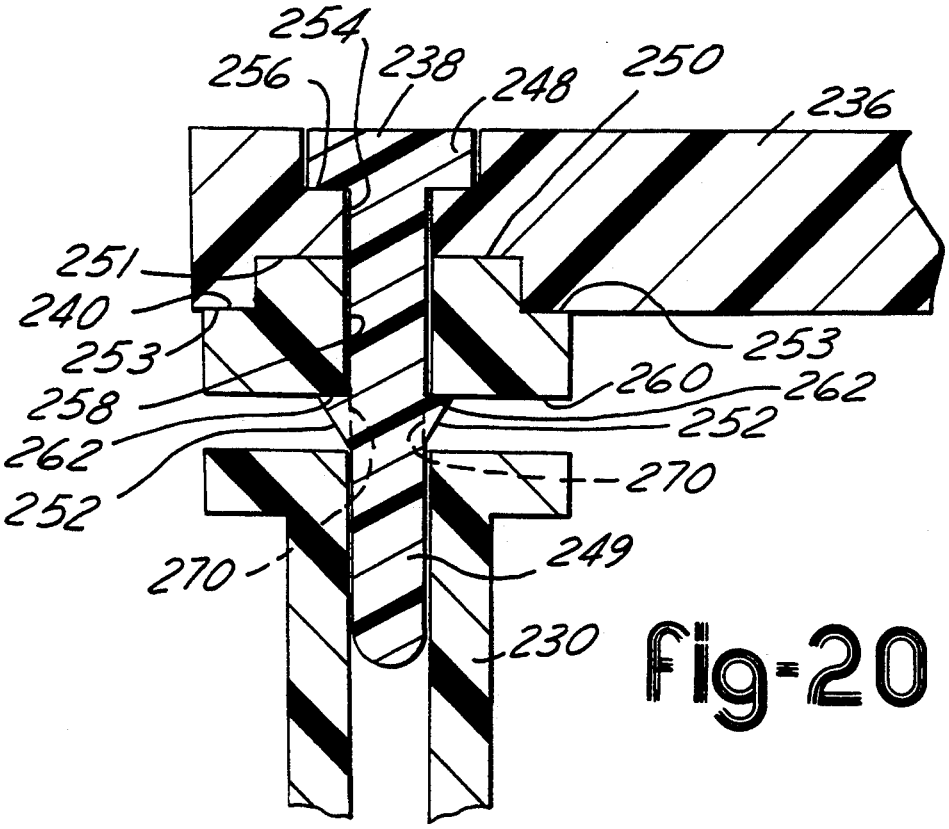
FIG. 20 is an enlarged fragmentary view taken from FIG. 18.

FIG. 20 shows an enlarged view of a retainer 238 holding a slat 236 to top surface 240 of rail 230. Retainer 238 has an enlarged head 248 and an elongate body 249 which extends therefrom. Body 249 has a pair of triangular-shaped opposed ribs 252 which extend longitudinally exteriorly from the main portion of body 249.

Slat 236 has an aperture 254 for receiving retainer 238. Aperture 254 has a countersink 256 which is sized and configured to receive enlarged head 248 of retainer 238 such that slat 236, retainer 238 and front rail 230 form a flush top surface. A countersink is defined as a an aperture having two spaced perimeters thereon, one perimeter being larger than the other.

Rail 230 has a vertically extending opening 258. Extending transverse to and intersecting with opening 258 is a slot 260 which forms a pair of shoulders 262.

Retainer 238 is inserted into aperture 254 of slat 236 and opening 258 of rail 230 to retain slat 236 to rail 230. Ribs 252 of retainer 238 are configured such that they may be pressed through aperture 254 and opening 258 until ribs 252 engage and interlock with respective shoulders 262. This engagement prevents retainer 238 from being withdrawn from opening 258 of rail 230. Likewise the engagement of enlarged head 248 of retainer 238 with countersink 256 of aperture 254 of slat 236 prevents slat 236 from disengaging retainer 238.

A third interlocking feature is also demonstrated in FIG. 20. Rail 230 has a vertically outward extending stake 250 thereon. Also, the underside of slat 236 has an inverted U-shaped recess 251 forming a pair of vertically extending and longitudinally spaced flanges 253. Stake 250 and U-shaped recess 251 cooperate with one another to prevent relative longitudinal movement between rail 230 and slat 236.

Figure 19:
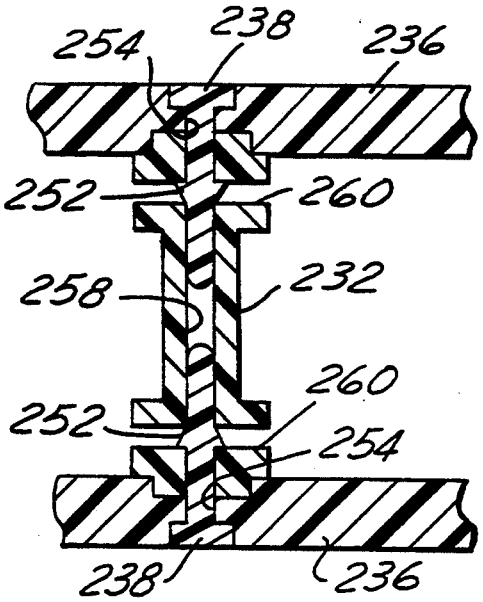
FIG. 19 is a sectional view looking along line 19—19 of FIG. 16.

The combination of the above identified interlocking features results in strong interlocking connections being formed at the intersections between slats 236, retainers 238 and the respective rails 230, 232, 233 and 234. FIG. 19 shows a pair of slats 236 being joined to the first intermediate rail 232 in a manner similar to that just described.

In the event a slat is damaged, it may be easily replaced. To do so, slat 236 is cut laterally between retainers 238 and each of the corresponding notches 245 formed in rails 230, 232, 233 and 234. The cut segments of slats 236 may then be longitudinally withdrawn from notches 244 or 246 and retainers 238.

Next, each of the ribs 252 of each of the corresponding retainers 238 is gouged out with a high-temperature, heated scoop to form generally smooth surfaces 270 on retainer 238 as seen in FIG. 20. This allows retainers 238 to be withdrawn without damaging rails 230, 232, 233 and 234.

A new slat 236 may then be pressed into notches 244 or 246 of rails 230, 232, 233 and 234. Finally, retainers 238 are pressed into apertures 254 of slats 236 and openings 258 of rails 230, 232, 233 and 234.

A method for constructing a recyclable plastic pallet, as described above, would include the steps of molding a rail 232 with an opening 258 therein, molding a slat 236 with an aperture 254, and providing a retainer 238. Slat 236 is then aligned relative to the rail 232 and retainer 238 is inserted into aperture 254 of slat 236 and opening 258 of rail 232 to cooperatively interlock slat 236 to rail 232.

Ideally, pallets 20 and 220 described above are recyclable and are made from previously used pallets. A method for redeploying a pallet 20 or 220 having member components such as the rails, slats and retainers described above includes the following steps. A previously used pallet is provided. The pallet should have the characteristic of being formed from recyclable material. The pallet is cut up and ground into granules.

The granules are fed into a heater producing a melt. The melt is poured into molds having internal cavities which define the contours of the member components of the pallet 20 or 220. The melt is allowed to cool, thereby producing the member components of the pallet. A new pallet 20 or 220 is then assembled from the member components so that the new pallet 20 or 220 is free of materials which cannot be recycled.

While this invention has been described in the foregoing specification in relation to certain preferred embodiments thereof, and many details have been set forth for the purpose of illustration, it will be apparent to those skilled in the art that the invention is susceptible to additional embodiments and that certain details described herein can be varied considerably without departing from the basic principles of the invention.

For example, slats 236 and retainers 238 may be integrally molded as one-piece slats. These one-piece slats with longitudinally spaced retainers could be installed into notches 244 and 246 of rails 230, 232, 233 and 234 and their respective openings 258 to construct a pallet.

However, it is preferred to use the above described embodiment with separate retainers 238 and slats 236 along with rails 230, 232, 233 and 234. These discrete parts may be more compactly packaged for transport than are pallets which are already partially constructed. The reduction in packaging space for an assembled pallet 220 versus an unassembled pallet 220, is on the order of ten-fold. As an example, 2000–3000 unassembled pallets may be carried on a truck trailer as compared to 200–300 assembled pallets 220.

What is claimed is:

1. A pallet upon which objects may be stacked, the pallet comprising:

longitudinally spaced and laterally extending elongated front and back rails, the rails having vertically spaced top and bottom surfaces and at least one of the rails having a vertically extending opening formed therein;

laterally spaced and longitudinally extending elongate slats, at least one of the slats having an aperture formed therein; and a retainer cooperatively held in the opening of the rail and in the aperture of the slat, the retainer including a body having at least one rib extending transverse to the opening in the rail, the opening having at least one shoulder formed therein extending traverse to the opening and the body and rib being oversized relative to the shoulder such that the rib is cooperatively received in a snap-fit manner within the shoulder to prevent the retainer from being withdrawn from the opening.

2. The pallet of claim 1 wherein the rail has a slot extending inclined to and intersecting with the opening to provide access to the rib, the shoulder being formed by the intersection of the opening and the slot.

3. The pallet of claim 1 wherein the slat has a pair of vertically and longitudinally extending flanges located on the underside thereof which sandwich about the top or bottom surface of the rail to prevent relative lateral movement between the slat and the rail.

4. The pallet of claim 1 wherein the slat and the retainer are integrally molded together.

5. The pallet of claim 1 wherein:

the rib has an inclined ramp surface leading to a bearing surface;

wherein when the retainer is inserted into the opening, the ramp surface slides along the opening with the opening enlarging to accommodate the rib and then contracting after the bearing surface has passed the shoulder with the bearing surface bearing upon the shoulder to prevent withdrawal of the retainer from the opening.

6. The pallet of claim 5 wherein the rib is triangular in cross-section.

7. The retainer of claim 1 wherein the body of the retainer is non-circular in cross-section.

8. The retainer of claim 1 wherein the rib is elongate and extends horizontally.

9. The retainer of claim 1 wherein:

the retainer includes two discrete opposing ribs located on opposite sides of the body of the retainer and the opening has two shoulders formed therein, the ribs interlocking with the shoulders to prevent withdrawal of the retainer from the opening.

10. A pallet upon which objects may be stacked, the pallet comprising:

longitudinally spaced and laterally extending elongate front and back rails, the rails having vertically spaced top and bottom surfaces and at least one of the rails having an opening formed therein;

laterally spaced and longitudinally extending elongate slats, at least one of the slats having an aperture formed therein; and a retainer cooperatively held in the opening of the rail and in the aperture of the slat, thereby joining the slat and rail together;

wherein at least one of the rails has a notch in at least one of its top or bottom surfaces, the notch having an undercut and the slat having a laterally outward extending flange, the flange and the undercut cooperating to form an interlocking joint retaining the slat within the notch of the rail.

11. A method of joining a slat to a rail in a recyclable plastic pallet, the method comprising the steps of:

molding a slat having an aperture;

molding a rail having an opening including a shoulder extending transverse to the opening;

molding a retainer having a body with a rib thereon, the body and rib being oversized relative to the shoulder of the opening;

inserting the retainer into the aperture of the slat and into the opening of the rail with the rib passing into the opening and being received within the shoulder of the opening in a snap-fit manner, thereby cooperatively interlocking the slat, the rail and retainer to one another.

12. The method of claim 11 wherein the rail includes a slot extending transverse to and intersecting with the opening of the rail, the shoulder being formed by the intersection of the opening and the slot.

13. The method of claim 11 wherein the slat includes a laterally outward extending flange and the rail has a notch including an undercut, the undercut and the laterally outward extending flange cooperatively interlocking with one another to retain the slat to the rail.

14. A pallet upon which objects may be stacked, the pallet comprising:

longitudinally spaced and laterally extending elongate front and back rails, the rails having vertically spaced top and bottom surfaces and at least one of the rails having an opening formed therein;

laterally spaced and longitudinally extending elongate slats, at least one of the slats having an aperture formed therein; and a retainer cooperatively held in the opening of the rail and in the aperture of the slat, thereby joining the slat and rail together;

wherein at least one of the rails has a notch in at least one of its top or bottom surfaces, the slat and the retainer being received within the notch such the slat, the retainer and the rail form a flush surface on the pallet.

15. The pallet of claim 14 wherein the slat, the rail and the retainer have both longitudinal and laterally extending interlocking stepped surfaces which interlock with one another to prevent the slat from moving laterally or longitudinally relative to the rail.

16. A method for removing and replacing a slat from a rail of a recyclable plastic pallet, the slat having an aperture formed therein, the rail having an opening with a shoulder formed therein, and a retainer, the retainer having a head and a body with a rib thereon, the head being cooperatively held in the aperture of the slat and the rib being cooperatively held in the shoulder of the opening, the method comprising:

cutting the slat between the retainer and the rail;

removing the slat from the rail;

removing the rib from the retainer;

withdrawing the retainer from the rail;

placing another slat, having an aperture, upon the rail; and inserting another retainer into the aperture of the slat and into the opening of the rail to retain the second slat to the rail.

17. A method for removing and replacing a slat from a rail of a recyclable plastic pallet, the slat having an aperture formed therein, the rail having an intersecting opening and a slot extending transverse thereto forming a shoulder at the intersection of the opening and slot, and a retainer which fastens the slat to the rail, the retainer having a body with a rib thereon, the body and rib being oversized relative to and received within the shoulder of the opening in a snap-fit manner to retain the retainer within the slat and rail, the method comprising:

accessing the rib through the slot and removing the rib from the retainer;

withdrawing the retainer from the opening and aperture;

removing the slat from the rail;

withdrawing the retainer from the rail;

placing a second slat, having an aperture, upon the rail; and inserting a second retainer having a rib thereon into the aperture of the a second slat and into the opening of the rail with the rib of the second retainer being captured within the shoulder of the opening to retain the second slat to the rail.

* * * * *